US009321606B2

(12) United States Patent
Kobayashi et al.

(10) Patent No.: US 9,321,606 B2
(45) Date of Patent: Apr. 26, 2016

(54) IMAGE FORMING APPARATUS

(71) Applicants: Akihito Kobayashi, Nagoya (JP); Kohei Terada, Kiyosu (JP)

(72) Inventors: Akihito Kobayashi, Nagoya (JP); Kohei Terada, Kiyosu (JP)

(73) Assignee: Brother Kogyo Kabushiki Kaisha, Nagoya-shi, Aichi-Ken (JP)

( * ) Notice: Subject to any disclaimer, the term of this patent is extended or adjusted under 35 U.S.C. 154(b) by 0 days.

(21) Appl. No.: 14/190,316

(22) Filed: Feb. 26, 2014

(65) Prior Publication Data

US 2014/0291921 A1 Oct. 2, 2014

(30) Foreign Application Priority Data

Mar. 29, 2013 (JP) ..... 2013-074393

(51) Int. Cl.

| | |
|---|---|
| ***B65H 31/36*** | (2006.01) |
| ***B65H 31/26*** | (2006.01) |
| ***B65H 29/52*** | (2006.01) |
| ***B65H 31/02*** | (2006.01) |

(52) U.S. Cl.

CPC ..... *B65H 31/36* (2013.01); *B65H 29/52* (2013.01); *B65H 31/02* (2013.01); *B65H 31/26* (2013.01); *B65H 2301/4212* (2013.01); *B65H 2301/51256* (2013.01); *B65H 2404/62* (2013.01); *B65H 2404/63* (2013.01); *B65H 2511/20* (2013.01); *B65H 2801/27* (2013.01)

(58) Field of Classification Search

CPC ..... B65H 31/08; B65H 31/36; B65H 31/38; B65H 31/26

USPC ..... 271/217, 220, 214

See application file for complete search history.

(56) References Cited

U.S. PATENT DOCUMENTS

| | | | | |
|---|---|---|---|---|
| 8,485,523 | B2 * | 7/2013 | Kimura et al. | 271/220 |
| 2004/0070141 | A1 * | 4/2004 | Michels et al. | 271/220 |
| 2005/0280203 | A1 * | 12/2005 | Ozcariz Eizaguirre | 271/214 |
| 2010/0096801 | A1 * | 4/2010 | Yanagida | 271/220 |
| 2011/0148031 | A1 * | 6/2011 | Shih et al. | 271/223 |

FOREIGN PATENT DOCUMENTS

| | | | |
|---|---|---|---|
| JP | 01192664 A * | 8/1989 | B65H 31/26 |
| JP | H01-267263 | 10/1989 | |
| JP | H08-268626 | 10/1996 | |
| JP | 2002-211814 | 7/2002 | |
| JP | 2003-081515 | 3/2003 | |
| JP | 2006-225119 | 8/2006 | |
| JP | 2012-250788 | 12/2012 | |

* cited by examiner

*Primary Examiner* — Michael McCullough

(74) *Attorney, Agent, or Firm* — Frommer Lawrence & Haug LLP

(57) ABSTRACT

An image forming apparatus includes: a discharge tray having a supporting surface supporting a recording medium; a discharge mechanism which has a discharging slot through which the recording medium on which an image is formed is discharged and is provided to discharge the recording medium from the discharging slot in a discharge direction which is a direction toward a space vertically above the supporting surface of the discharge tray; and a press down unit which is configured to relatively move toward and away from the supporting surface with respect to the discharge tray, the press down unit being relatively moved away when contacting with a downstream end in the discharge direction of the recording medium discharged onto the discharge tray by the discharge mechanism, and applying the own weight to the downstream end of the recording medium when the recording medium is supported by the supporting surface.

12 Claims, 10 Drawing Sheets

IMAGE FORMING APPARATUS

CROSS REFERENCE TO RELATED APPLICATION

The present application claims priority from Japanese Patent Application No. 2013-074393, which was filed on Mar. 29, 2013, the disclosure of which is incorporated herein by reference in its entirety.

BACKGROUND OF THE INVENTION

1. Field of the Invention

The present invention relates to an image forming apparatus configured to form an image on a recording medium and discharge the recording medium to a discharge tray.

2. Description of Related Art

It has been known that a recording medium on which an image is formed tends to curl. For example, a recording medium printed by an inkjet printer curls as the surface having absorbed the moisture of ink swells. On the other hand, a recording medium printed by an electrophotographic printer curls on account of the heat applied at the time of fixation. When such a curling recording medium is supported by a discharge tray, the recording medium discharging slot of the discharge tray is blocked and paper jam occurs. To prevent the occurrence of paper jam due to the curling of a recording medium, a known image forming apparatus has a press down unit which is configured to contact with the surface of the recording medium supported by the discharge tray so as to press down the recording medium.

SUMMARY OF THE INVENTION

In the above-described image forming apparatus, because the press down unit contacts with the surface of the recording medium, the recording medium rubs against the press down unit, with the result that the surface of the recording medium may be polluted or damaged.

In this regard, an aspect of the present invention is to provide an image forming apparatus in which a recording medium supported by a discharge tray is pressed down while the pollution or damage of the recording medium is restrained.

An image forming apparatus according to an embodiment includes; a discharge tray having a supporting surface supporting a recording medium; a discharge mechanism which has a discharging slot through which the recording medium on which an image is formed is discharged and is provided to discharge the recording medium from the discharging slot in a discharge direction which is a direction toward a space vertically above the supporting surface of the discharge tray; and a press down unit which is configured to relatively move toward and away from the supporting surface with respect to the discharge tray, the press down unit being relatively moved away as the press down unit contacts with a downstream end in the discharge direction of the recording medium discharged onto the discharge tray by the discharge mechanism, and applying the own weight to the downstream end of the recording medium when the recording medium is supported by the supporting surface of the discharge tray.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

First Embodiment

The following will describe First Embodiment with reference to figures.

Figure 1:
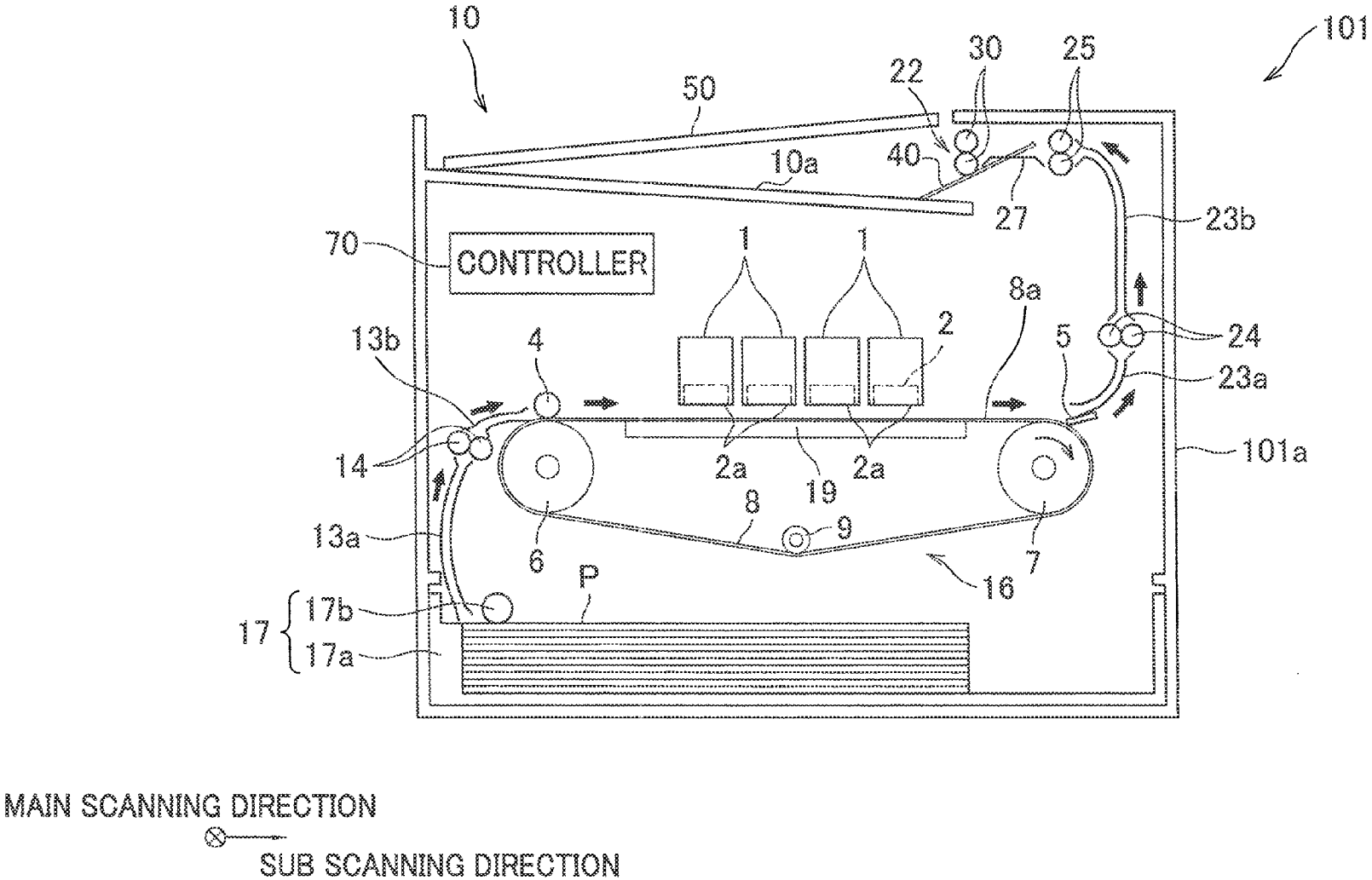
FIG. 1 is a schematic profile showing the overall structure of an inkjet printer of First Embodiment.

As shown in FIG. 1, an inkjet printer 101 of the present embodiment has a substantially rectangular parallelepiped housing 101*a*, and, in the housing 101*a*, four inkjet heads 1, a conveyance mechanism 16 which is configured to convey a sheet P in a conveyance direction (i.e., rightward in FIG. 1), and a sheet supply unit 17 which is configured to supply the sheet P are lined up downward. On the top plate of the housing 101*a*, a discharging slot 22 configured to discharge sheets P and a discharge tray 10 where the sheets P are discharged from the discharging slot 22 are provided. The discharge tray 10 is formed as a concave portion on the upper surface of the housing 101*a*, and its bottom functions as a supporting surface 10*a* supporting sheets P. The supporting surface 10*a* is inclined downward toward the discharging slot 22. Furthermore, a tail end press down unit 40 and a leading end press down unit 50 are provided for pressing down the sheet P supported by the supporting surface 10*a* of the discharge tray 10. In the housing 101*a*, a controller 70 is provided to control the overall operations of the printer 101.

Four inkjet heads 1 eject cyan, magenta, yellow, and black inks, respectively. Each of these inkjet heads 1 is substantially rectangular parallelepiped and long in the main scanning direction. The inkjet heads 1 are lined up along the conveyance direction of sheets P. To put it differently, the inkjet printer 101 is a line-type printer, and the main scanning direction is orthogonal to the conveyance direction. Each inkjet head 1 has a head main body 2 having, at its lower surface, an ejection surface 2*a* through which a plurality of unillustrated ejection openings are made through.

The conveyance mechanism 16 has two belt rollers 6 and 7, a conveyance belt 8, a tension roller 9, and a platen 19. The conveyance belt 8 is an endless belt wrapping between the rollers 6 and 7 and is tensioned by the tension roller 9. The platen 19 is provided in the region encircled by the conveyance belt 8, and supports the conveyance belt at positions opposing the four inkjet heads 1. The belt roller 7 is a drive roller driven by a motor 61 (see FIG. 6). With this arrangement, the conveyance mechanism 16 drives the belt roller 7 so as to move the conveyance belt 8, with the result that a sheet P placed on the conveyance surface 8*a* of the conveyance belt 8 is conveyed.

The sheet supply unit 17 is detachably attached to the housing 101*a*, and includes a sheet feeding tray 17*a* housing a plurality of sheets P and a pickup roller 17*b* which is driven by a motor 62 (see FIG. 6) so as to send out the topmost sheet P in the sheet feeding tray 17*a*. The sheet P sent out from the sheet feeding tray 17*a* is forwarded to the conveyance mechanism 16 along guides 13*a* and 13*b* by a feed roller pair 14 which is driven by a motor 63 (see FIG. 6).

In the printer 101, a conveying path indicated by black arrows is formed as shown in FIG. 1. The sheet P sent from the sheet supply unit 17 to the conveyance mechanism 16 is pressed down onto the conveyance surface 8*a* by a press down roller 4. When the sheet P passes an opposing region opposing the ejection surface 2*a* of each inkjet head 1, a desired color image is formed on the upper surface of the sheet P. The sheet P on which the image has been formed is peeled off from the conveyance surface 8*a* by a peeling unit 5 provided immediately downstream of the conveyance mechanism 16, and is then conveyed upward along guides 23*a* and 23*b* by a feed roller pair 24 which is driven by a motor 64 (see FIG. 6). Furthermore, the sheet P is horizontally sent out by a feed roller pair 25 which is driven by a motor 65 (see FIG. 6) and conveyed while the lower surface is supported by a guide 27, and finally the sheet P is sandwiched between the rollers of an ejection roller pair 30 which is provided in the vicinity of the discharging slot 22 and driven by a motor 66 (see FIG. 6), and discharged through the discharging slot 22 toward a space which is vertically above the supporting surface 10*a* of the discharge tray 10. In the descriptions below, the direction in which a sheet P is discharged by the ejection roller pair 30 will be simply referred to as "discharge direction".

Figure 2:
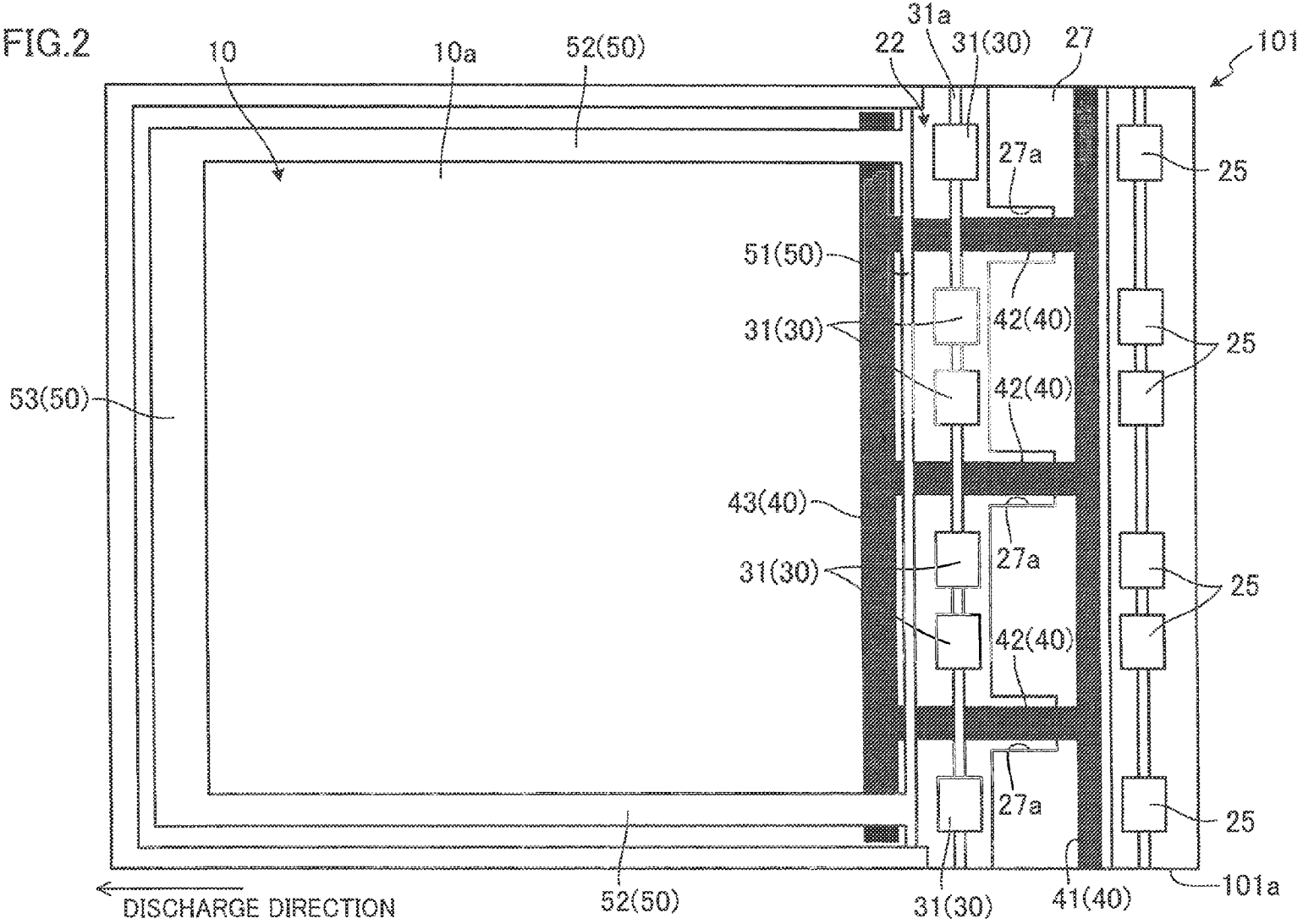
FIG. 2 shows the inkjet printer of FIG. 1 from above.

Now, referring further to FIGS. 2 and 3, the tail end press down unit 40 and the leading end press down unit 50 will be detailed. It is noted that, in FIG. 2 showing the inkjet printer 101 from above, a top plate is removed except at a part of the housing 101*a* where the discharge tray 10 is provided, for convenience of explanation.

The tail end press down unit 40 is supported by the inner wall of the housing 101*a* so as to be rotatable about a supporting shaft 41. The supporting shaft 41 extends in the direction orthogonal to the discharge direction in plan view (hereinafter, this direction will be simply referred to as the direction orthogonal to the discharge direction), and is on the upstream of the discharging slot 22 in the discharge direction and above the conveying path (indicated by dashed lines in FIG. 3A and FIG. 3B) of sheets P defined by the ejection roller pair 30. As shown in FIG. 2, the supporting shaft 41 is connected to three arms 42 which extend in the direction orthogonal to the length of the supporting shaft 41 and are provided at regular intervals. Each arm 42 is uniformly thick over the entire length and extends straight. The end portions of the three arms 42, which are on the opposite side to the supporting shaft 41, are connected to a single press down part 43 which extends in the direction orthogonal to the discharge direction.

Figure 3A:
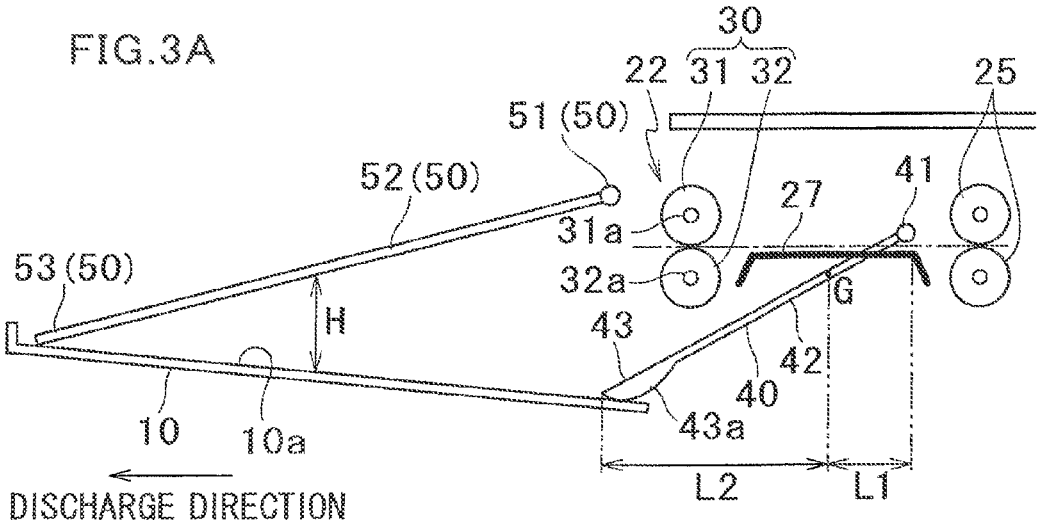
FIG. 3A illustrates the operations of the tail end press down unit and the leading end press down unit shown in FIG. 1, in which no sheet is supported by the discharge tray.
Figure 4A:
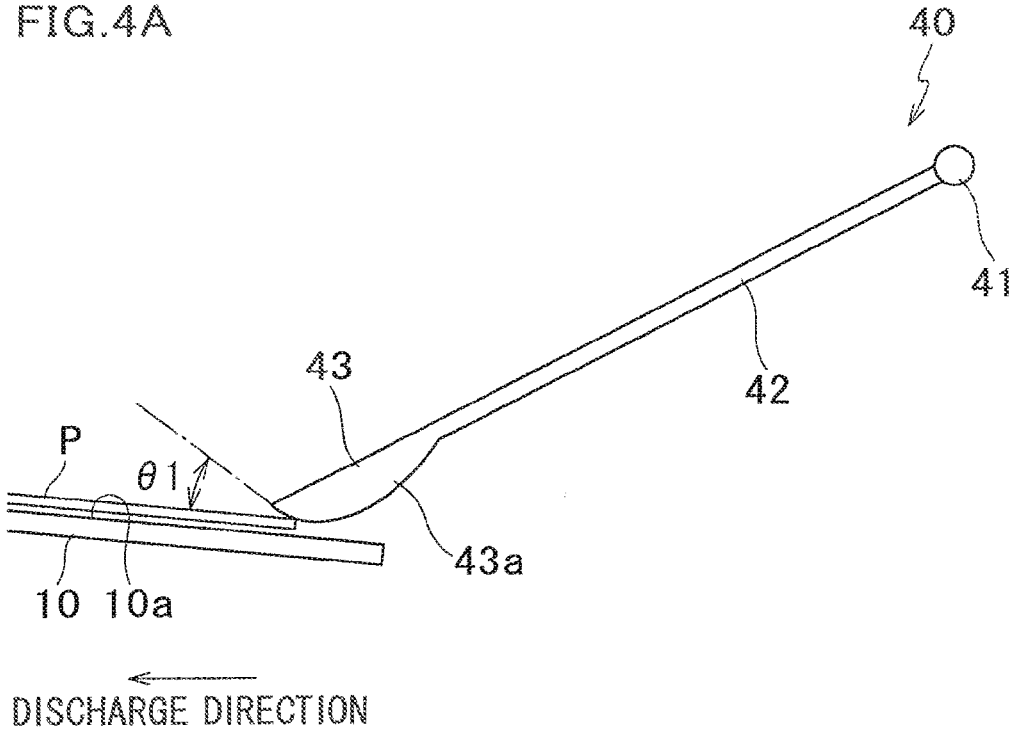
FIG. 4A shows an angle formed between the abutting surface of the tail end press down unit and the upper surface of the sheet.
Figure 4B:
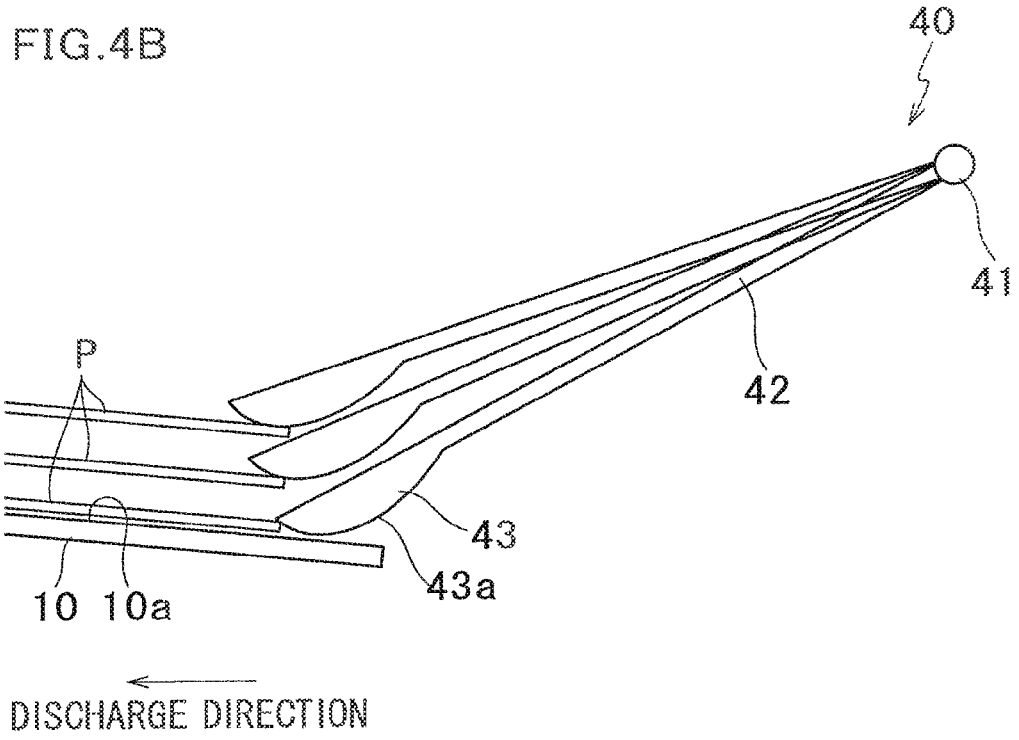
FIG. 4B shows the operation of the tail end press down unit which the discharge tray supports two or more sheets.

The press down part 43 is disposed outside the housing 101*a*, and extends to reach the respective ends in the width direction of the supporting surface 10*a* of the discharge tray 10, in the width direction of the sheet P supported by the supporting surface 10*a* of the discharge tray 10. The lower surface of the press down part 43 is curved to protrude downward, so as to function as an abutting surface 43*a* which presses down an end of the upper surface of the sheet P supported by the supporting surface 10*a* of the discharge tray 10, which end is on the upstream in the discharge direction. As shown in FIG. 3A, the abutting surface 43*a* contacts with the supporting surface 10*a* of the discharge tray 10, when the discharge tray 10 does not support any sheet P. When the sheet P supported by the supporting surface 10*a* of the discharge tray 10 is pressed down, as shown in FIG. 4A, the angle $\theta_1$ formed by the abutting surface 43*a* and the upper surface of the sheet P is an acute angle. As shown in FIG. 4B, even if the number of sheets P supported on the discharge tray 10 is large, the abutting surface 43*a* always presses down the upstream end in the discharge direction of the upper surface of the sheet P.

The center of gravity of the tail end press down unit 40 is indicated as G in FIG. 3A. As shown in FIG. 3A, the length L1 from the center of gravity G to the supporting shaft 41 is shorter than the length L2 from the center of gravity G to the abutting surface 43*a*.

Figure 3B:
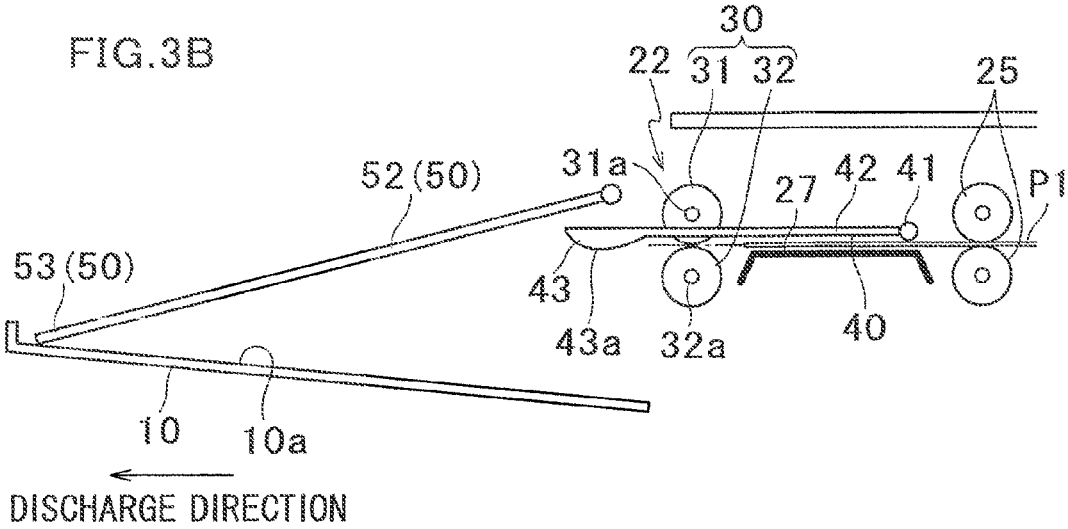
FIG. 3B illustrates the operations of the tail end press down unit and the leading end press down unit shown in FIG. 1, in which a sheet is being transported toward the discharging slot.
Figure 3C:
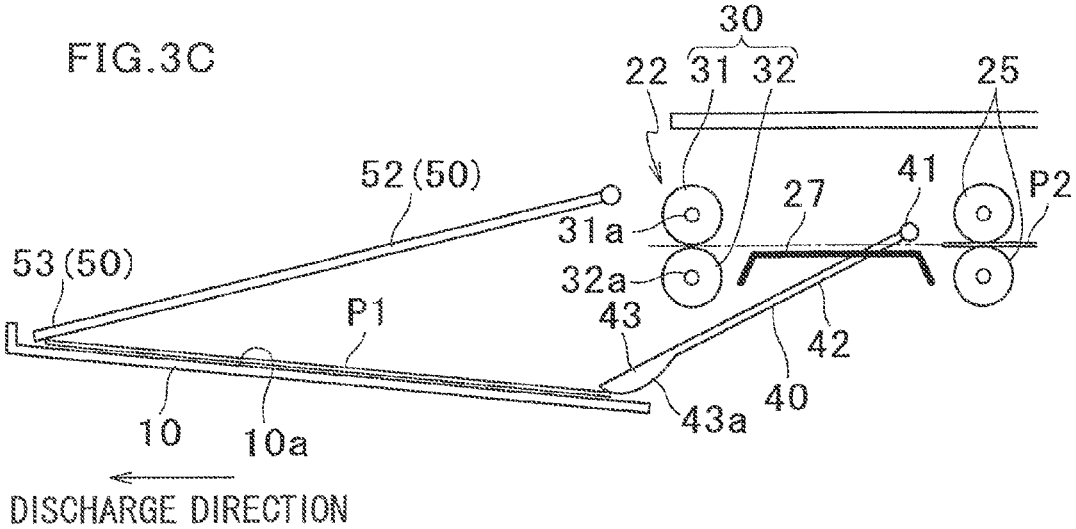
FIG. 3C illustrates the operations of the tail end press down unit and the leading end press down unit shown in FIG. 1, in which a sheet is being supported by the discharge tray.

The tail end press down unit 40 is arranged such that, when the abutting surface 43*a* contacts with the supporting surface 10*a* of the discharge tray 10 as shown in FIG. 3A or contacts with the sheet P1 supported by the supporting surface 10*a* as shown in FIG. 3C, the arms 42 intersect with the conveying path of the sheets P formed by the ejection roller pair 30. When the sheet P1 is supplied to the surface of the guide 27 by the feed roller pair 25, the arms 42 are pushed on account of the contact with the sheet P1, with the result that the tail end press down unit 40 rotates upward (away from the supporting surface 10*a*) as shown in FIG. 39. As shown in FIG. 2, the guide 27 has a notch 27*a* which is provided to avoid the interference with the rotating tail end press down unit 40.

As shown in FIG. 2, first ejection rollers 31 of the ejection roller pair 30, which are above the conveying path, are provided on a single roller shaft 31*a* which extends in the direction orthogonal to the discharge direction. The both ends of the roller shaft 31*a* are rotatably supported by the inner wall surfaces of the housing 101*a*. On the other hand, second ejection rollers 32 of the ejection roller pair 30, which are below the conveying path, are provided on roller shafts 32*a* (see FIG. 3A and FIG. 3B) in a similar manner as the first ejection rollers 31. The roller shafts 32*a* having the second ejection rollers 32, however, are plural in number and distanced from one another in the direction orthogonal to the discharge direction, to avoid the interference with the rotating tail end press down unit 40.

With the arrangement above, the tail end press down unit 40 having rotated upward as shown in FIG. 3B passes a gap between the roller shafts 32*a* each having the second ejection rollers 32, and contacts with the roller shaft 31*a* of the first ejection rollers 31. At this stage, the entirety of the tail end press down unit 40 is above the conveying path formed by the ejection roller pair 30. The sheet P1 having pushed up the tail end press down unit 40 passes below the tail end press down unit 40 while being supported by the guide 27 at its lower surface, and is then discharged to the discharge tray 10 through the discharging slot 22.

As shown in FIG. 3C, when sheets P1 and P2 are serially discharged through the discharging slot 22, the tail end press down unit 40 contacts with the sheet P1 after the sheet P1 which is discharged first is supported by the discharge tray 10 and before the sheet P2 which is subsequently discharged is supported by the discharge tray 10. That is to say, provided that the time from the contact of the first sheet P1 with the arms 42 of the tail end press down unit 40 on the conveying path to the contact of the second sheet P2 with the arms 42 of the tail end press down unit 40 on the conveying path is $t_0$, the time from the contact of the first sheet P1 with the arms 42 of the tail end press down unit 40 on the conveying path to the time point at which the sheet P1 leave the ejection roller pair 30 is $t_1$, and the time from the leaving of the first sheet P1 from the ejection roller pair 30 to the time point at which the tail end press down unit 40 rotating downward (toward the sheet P supported by the supporting surface 10*a*) contacts with the sheet P1 is $t_2$, the time T during which the tail end press down unit 40 presses down the first sheet P1 is represented by the following equation (1).

$$T=t_0-t_1-t_2 \quad (1)$$

In this regard, the time $t_0$ from the contact of the first sheet P1 with the arms 42 to the contact of the second sheet P2 with the arms 42 is determined by the conveyance speed of each of the sheets P1 and P2 and the distance between the sheets P1 and P2. The time $t_1$ until the first sheet P1 leaves the ejection roller pair 30 is determined by the conveyance speed of the sheet P1. In other words, the press-down time T of the sheet P1 represented by the equation (1) is varied by changing the conveyance speed of each of the sheets P1 and P2 and/or the distance between the sheets P1 and P2. For the reason above, the conveyance speed of each of the sheets P1 and P2 and/or the distance between the sheets P1 and P2 is adjusted by the controller 70 so that, for example, the press-down time T is adjusted to be long for sheets which easily curl due to high-duty printing (i.e., sheets on each of which a region where ink droplets hit occupies a large part thereof).

The leading end press down unit 50 is supported on the inner side of the side wall of the discharge tray 10 so as to be rotatable about the supporting shaft 51 (fulcrum). The supporting shaft 51 extends in a direction orthogonal to the discharge direction and is disposed on the downstream in the discharge direction of the discharging slot 22 and above the tail end press down unit 40 contacting with the roller shaft 31*a* of the first ejection roller 31, as shown in FIG. 3B. As shown in FIG. 2, with around the respective end portions of the supporting shaft 51, arms 52 are connected to extend in the direction orthogonal to the length of the supporting shaft 51 (i.e., orthogonal to the width direction of the sheet P supported by the supporting surface 10*a* of the discharge tray 10). The end portions of the two arms 52 opposite to the supporting shaft 51 are both connected to a single press down part 53 which extends in the direction orthogonal to the discharge direction. The distance H (see FIG. 3A) between the leading end press down unit 50 and the supporting surface 10*a* of the discharge tray 10 increases toward the upstream in the discharge direction (i.e., rightward in FIG. 3A).

Figure 5:
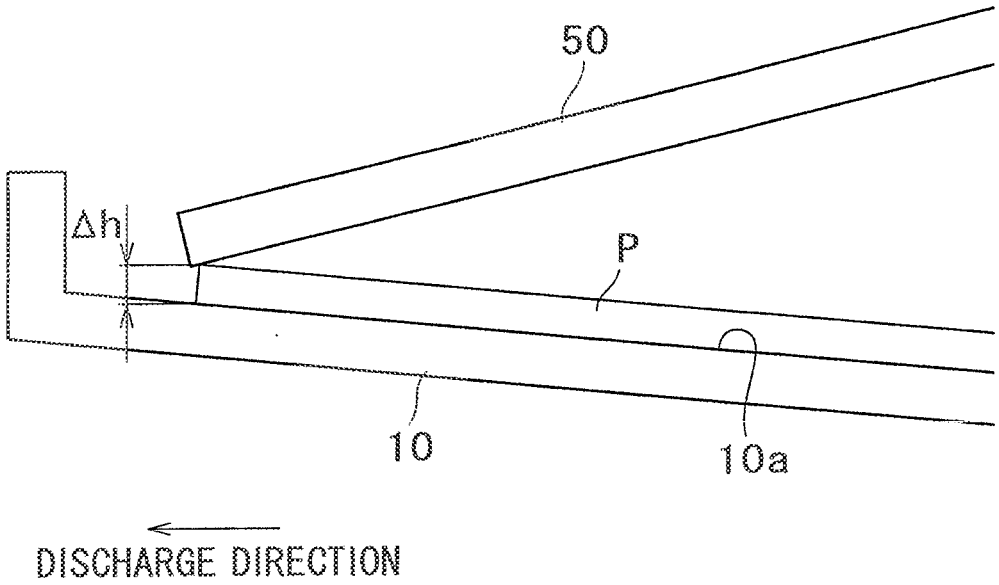
FIG. 5 is an enlarged view of a part of the sheet, at which part the sheet is pressed down by the leading end press down unit.

The leading end press down unit 50 rotates about the supporting shaft 51 so that the downstream end portion thereof in the discharge direction moves toward and away from the supporting surface 10*a* of the discharge tray 10. As shown in FIG. 3A, when no sheet P is supported by the discharge tray 10, the downstream end in the discharge direction of the leading end press down unit 50 contacts with the downstream end portion of the supporting surface 10*a* of the discharge tray 10. As shown in FIG. 3C, the leading end press down unit 50 moves upward (away from the supporting surface 10*a*) as it contacts with the downstream end in the discharge direction of the sheet P discharged onto the discharge tray 10. That is to say, at this stage, the downstream end of the leading end press down unit 50 floats off from the supporting surface 10*a*. More specifically, as shown in FIG. 5, the leading end press down unit 50 contacts only with the upper edge of the downstream end in the discharge direction of the sheet P supported by the supporting surface 10*a* of the discharge tray 10, so as to apply its own weight to the upper edge of the downstream end.

The controller 70 controls the motor 66 which drives the ejection roller pair 30 so that the sheet P is discharged onto the discharge tray 10 at a speed with which the kinetic energy of the sheet P discharged onto the discharge tray 10 is not smaller than the energy required to move the leading end press down unit 50 upward (away from the supporting surface 10*a*) by the height Δh (see FIG. 5) which is equivalent to one sheet P1 (and also controls, when necessary, the motor 64 driving the feed roller pair 24 and the motor 65 driving the feed roller pair 25).

Figure 6:
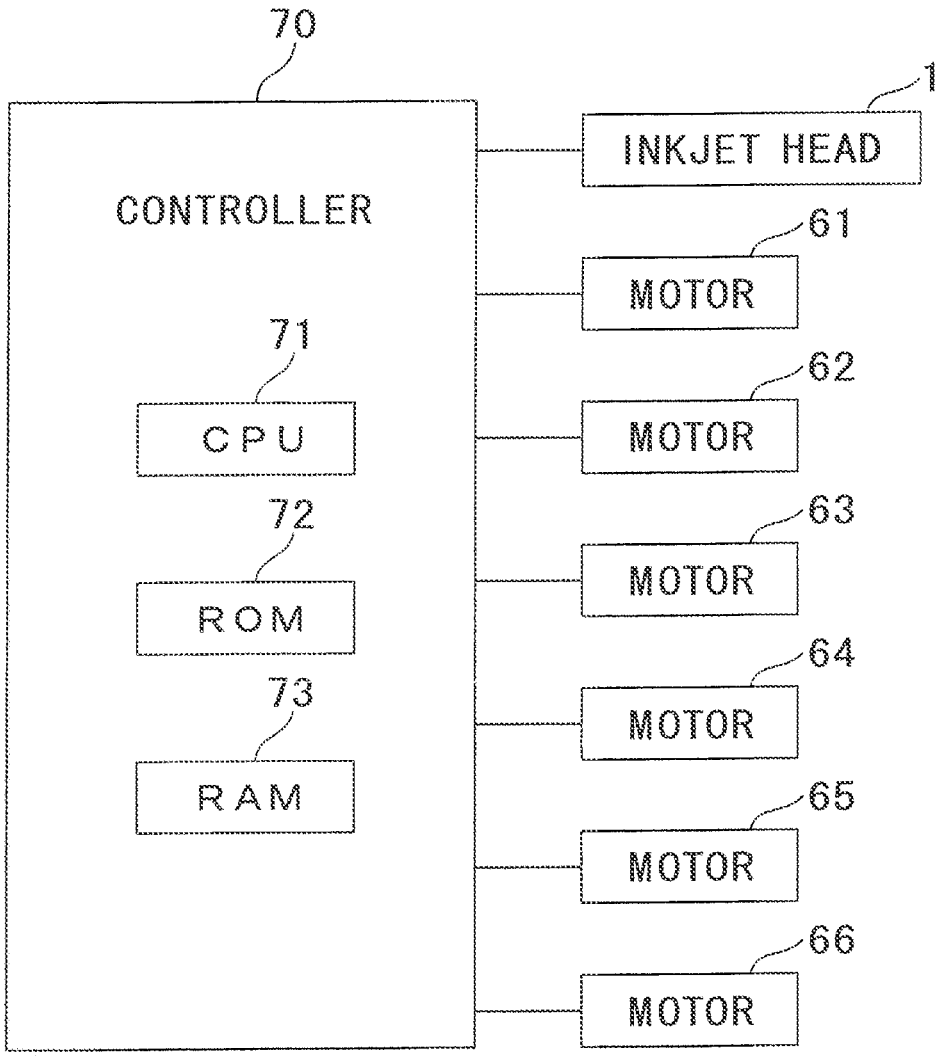
FIG. 6 is a functional block diagram of the controller of FIG. 1.

Now, the controller 70 will be described with reference to FIG. 6. The controller 70 includes a CPU (Central Processing Unit) 71, a ROM (Read Only Memory) 72, and a RAM (Random Access Memory) 73. Furthermore, the controller 70 is connected to various devices, driving units, and sensors of the inkjet printer 101 such as the four inkjet heads 1 and the motors 61 to 66.

The ROM 72 stores firmware which controls programs for controlling the inkjet printer 101 and various settings. The image formation on sheets P and the control of conveyance and discharge of sheets P are achieved as the firmware is executed by the CPU 71. The RAM 73 is used as a work area to which control programs are read or as a memory area where data is temporarily stored.

As described above, the inkjet printer 101 of the present embodiment includes the leading end press down unit 50 which is capable of moving toward and away from the supporting surface 10*a*. The leading end press down unit 50 moves away from the supporting surface 10*a* as it contacts with the downstream end in the discharge direction of the sheet P discharged onto the discharge tray 10 by the ejection roller pair 30, and applies its own weight onto the downstream end of the sheet P when the sheet P is supported by the supporting surface 10*a* of the discharge tray 10. This makes it possible to press down the sheet P supported by the supporting surface 10*a* of the discharge tray 10, while restraining the surface of the sheet P from being polluted or damaged on account of the friction between the leading end press down unit 50 and the sheet P.

Furthermore, in the inkjet printer 101 of the present embodiment, the leading end press down unit 50 includes the arms 52 which extend in the direction intersecting with the width direction of the sheet P supported by the supporting surface 10*a* of the discharge tray 10, and the distance between the leading end press down unit 50 and the supporting surface 10*a* increases toward the upstream in the discharge direction. This makes it difficult for all parts of the sheet P except the downstream end in the discharge direction to contact with the leading end press down unit 50, with the result that the pollution and damage of the surface of the sheet P on account of the friction between the leading end press down unit 50 and the sheet P are certainly restrained.

In addition to the above, the inkjet printer 101 of the present embodiment is arranged so that the leading end press down unit 50 is rotatable in such a way that its downstream end in the discharge direction is movable toward and away from the supporting surface 10*a*. It is therefore possible to allow, with a simple structure, the leading end press down unit 50 to move toward and away from the supporting surface 10*a* of the discharge tray 10.

Furthermore, the inkjet printer 101 of the present embodiment is arranged so that the controller 70 controls members such as the motor 66 which drives the ejection roller pair 30 so that the sheet P is discharged onto the discharge tray 10 at a speed with which the kinetic energy of the sheet P discharged onto the discharge tray 10 is not smaller than the energy required to move the leading end press down unit 50 away from the supporting surface 10*a* by the height which is equivalent to one sheet P. Because this makes it possible to change the positional relationship between the leading end press down unit 50 and the discharge tray 10 only by the kinetic energy of the discharged sheet P, the change in the positional relationship is achieved with low cost, without any additional power source.

Second Embodiment

Now, Second Embodiment will be described with reference to FIGS. 7 and 8. It is noted that, in FIG. 7 which shows an inkjet printer 201 of Second Embodiment from above, a top plate is removed except at a part of the housing 101*a* where the discharge tray 110 is provided, for convenience of explanation. It is noted that the following will describe arrangements different from those in First Embodiment and thus detailed description of the identical arrangements will be suitably omitted.

Figure 7:
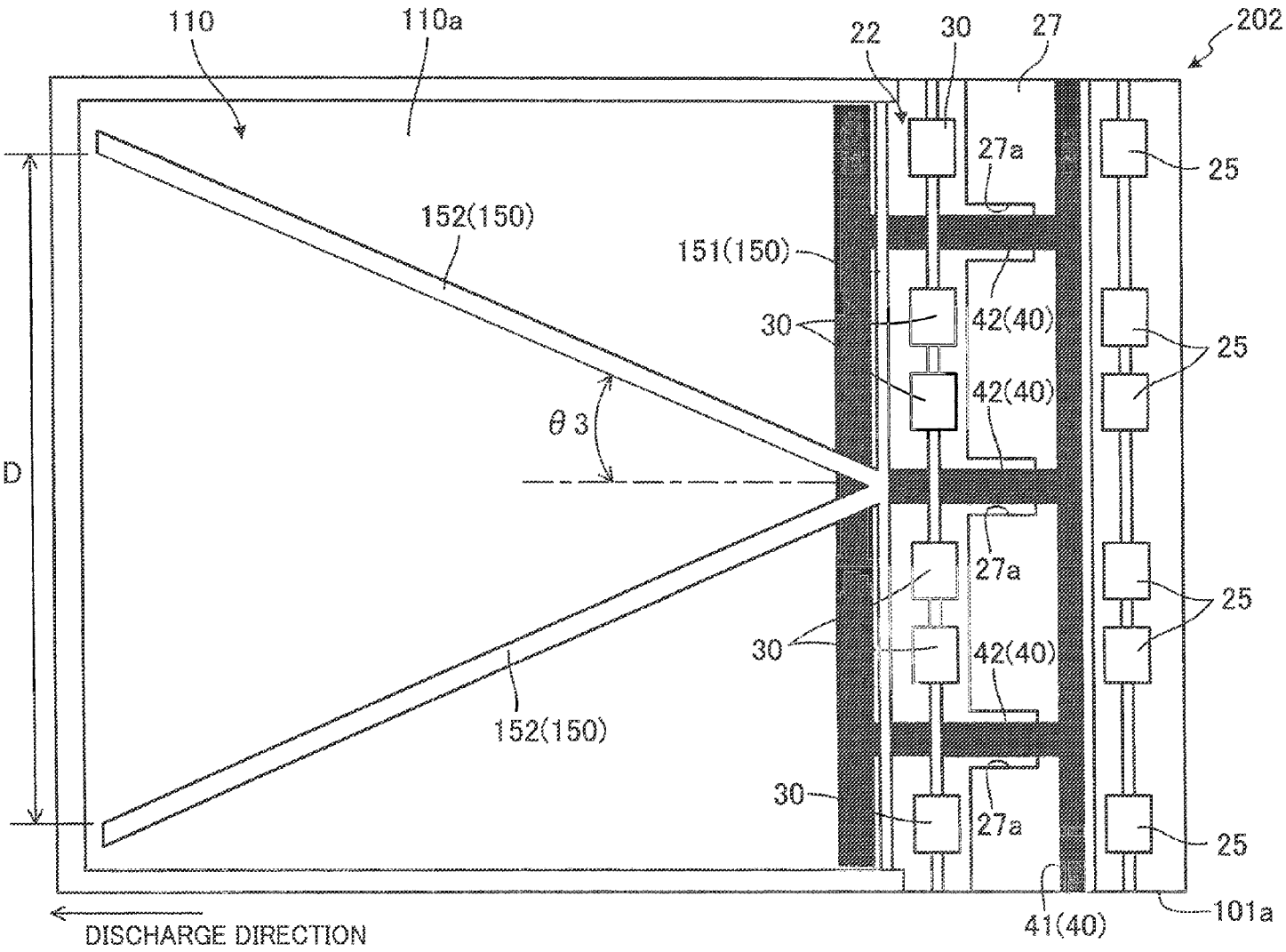
FIG. 7 shows an inkjet printer of Second Embodiment from above.

As shown in FIG. 7, the leading end press down unit 150 of the present embodiment includes a supporting shaft 151 (fulcrum) which extends in the direction orthogonal to the discharge direction and a pair of arms 152 that are both connected to the longitudinal center of the supporting shaft 151. The arms 152 linearly extend from the supporting shaft 151 so as to be away from each other in the direction orthogonal to the discharge direction, toward the downstream in the discharge direction. In other words, the pair of arms 152 forms a V-shape with the open side facing the downstream in the discharge direction, when the pair is viewed from above. The distance D (see FIG. 7) between the leading ends of the arms 152 is equivalent to the width of the largest sheet P used in the inkjet printer 201 of the present embodiment. Provided that the width of standard-sized sheets dealt with as the sheets P in the inkjet printer 201 is a, the length of the sheets is b, and the angle formed by each arm 152 and a linear line (indicated by a dashed line in FIG. 7) extending along the discharge direction is $\theta_3$, the following equation (2) holds.

$$\tan \theta_3 = 0.5a/b \quad (2)$$

As such, when the pair of arms 152 forms a V-shape with the open side facing the downstream in the discharge direction when viewed from above, the curl of the sheet P is effectively restrained by the mechanism described below. To begin with, as the sheet P is discharged from the discharging slot 22, the holding of the sheet P by the ejection roller pair 30 is canceled, with the result that the sheet P starts to curl from the edge of the sheet P to some degree, in the discharge direction and in the direction orthogonal to the discharge direction. With the sheet P discharged from the discharging slot 22, the pair of arms 152 contacts first at the central part in the direction orthogonal to the discharge direction of the downstream edge in the discharge direction of the sheet P. Subsequently, as the sheet P floats toward the downstream in the discharge direction, the contact positions between the arms 152 and the sheet P move outward from the central part in the direction orthogonal to the discharge direction of the downstream edge in the discharge direction of the sheet RAS the sheet P is stretched from the center toward the edges, the sheet P having curled from the edges uncurls, with the result that the curling of the sheet P is effectively restrained.

Figure 8:
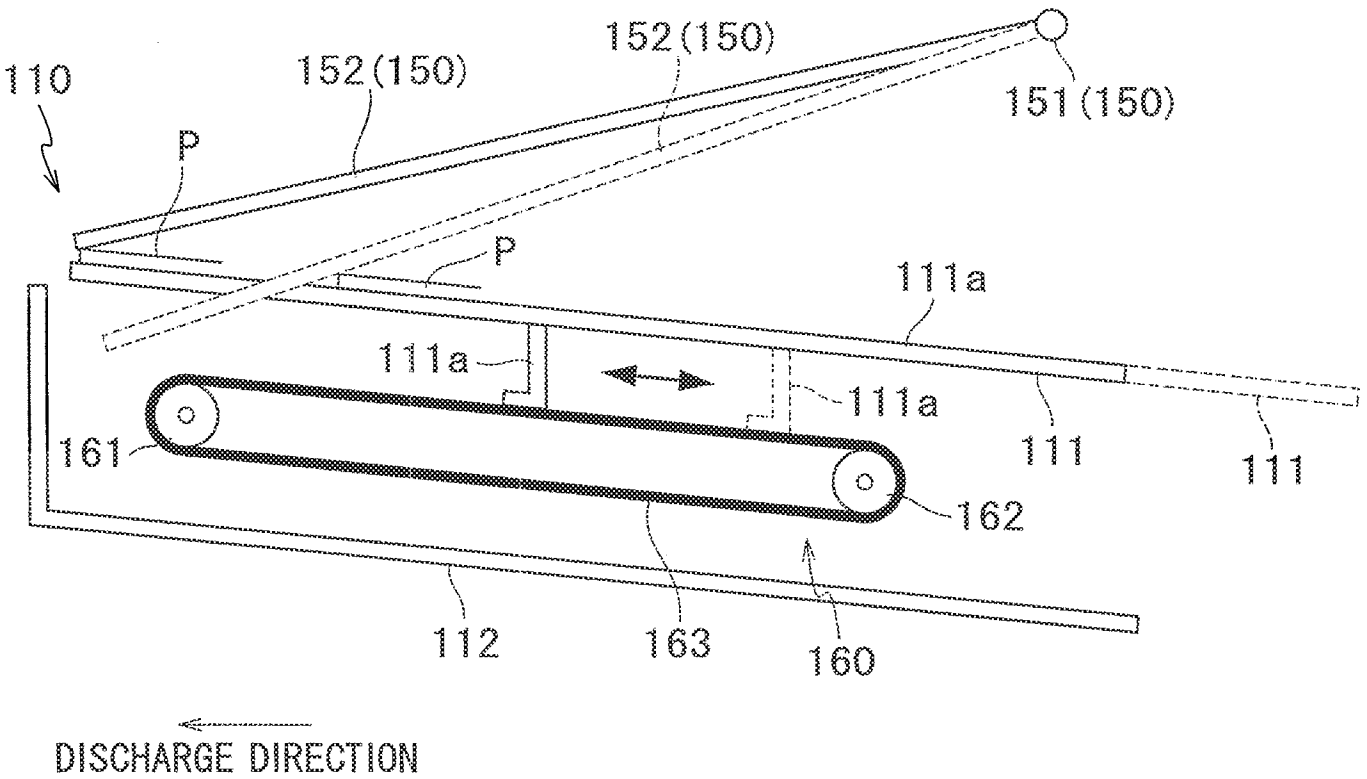
FIG. 8 shows the operations of the supporter of the discharge tray and the leading end press down unit shown in FIG. 7.

Furthermore, as shown in FIG. 8, in a discharge tray 110 of the present embodiment, a supporter 111 having an upper surface functioning as a supporting surface 110*a* supporting the sheet P is provided in a concave tray main body 112, and a moving mechanism 160 is provided to move the supporter 111 in the discharge direction and the direction opposite to the discharge direction.

The moving mechanism 160 includes a driven roller 161, a drive roller 162 driven by an unillustrated motor, and a drive belt 163. The driven roller 161 and the drive roller 162 are separated from each other in the discharge direction and are both rotatable about the respective rotation shafts that are orthogonal to the discharge direction. The drive belt 163 is an endless belt wrapping between the driven roller 161 and the drive roller 162. On the lower surface of the supporter 111 is formed a protrusion 111*a* which protrudes downward, and the lower end portion of this protrusion 111*a* is fixed to the drive belt 163. Therefore, as the drive roller 162 is rotated clockwise or anticlockwise by the motor, the drive belt 163 moves and the supporter 111 is moved in the discharge direction or the direction opposite to the discharge direction.

As indicated by the full lines in FIG. 8, when the supporter 111 is at the most downstream in the discharge direction, the leading end press down unit 150 contacts with the sheet P supported by the supporting surface 10*a*, at the downstream end in the discharge direction. As indicated by the broken lines in FIG. 8, when the supporter 111 is moved in the direction opposite to the discharge direction (i.e., rightward in the figure) by the moving mechanism 160, the leading end press down unit 150 rotates downward. At this stage, the downstream end in the discharge direction of the leading end press down unit 150 is below the supporter 111, and the contact position between the unit and the sheet P supported by the supporting surface 10*a* moves upstream in the discharge direction as compared to the downstream end. Therefore, at this stage, the distance between the contact positions where the arms 152 contact with the sheet P is shorter than the distance D between the leading ends of the arms 152. This makes it possible to press down a small-sized sheet P as compared to the case where the supporter 111 is at the most downstream in the discharge direction.

As described above, the inkjet printer 201 of the present embodiment is arranged so that the leading end press down unit 150 includes the pair of arms 152 which are more distant from each other in the direction orthogonal to the discharge direction, toward the downstream in the discharge direction. Because the sheet P supported by the supporting surface 110*a* of the discharge tray 110 is pressed down at two points which are distanced from each other in the width direction of the sheet P, the curling is further effectively corrected. Furthermore, as the leading end of the sheet P contacts with the arms 152 before the sheet P is supported by the supporting surface 110*a*, the curling of the sheet P is restrained.

In addition to the above, the inkjet printer 201 of the present embodiment is arranged so that the pair of arms 152 of the leading end press down unit 150 is V-shaped in plan view. Therefore, because the sheet P is pressed down at two points which are equidistant from the center, the curling is further effectively corrected.

In addition to the above, provided that the width of standard-sized sheets is a, the length of the sheets is b, and the angle formed by each arm 152 and a linear line extending along the discharge direction is $\theta_3$, the following equation (2) holds.

$$\tan \theta_3 = 0.5a/b \quad (2)$$

It is therefore possible to certainly press down a standard-sized sheet at two points.

In addition to the above, the inkjet printer 201 of the present embodiment includes the moving mechanism 160 which is configured to move the supporter 111 which has the upper surface functioning as the supporting surface 110*a* supporting the sheet P, in the discharge direction and the direction opposite to the discharge direction. This arrangement allows the leading end press down unit 150 to certainly press down differently-sized sheets P.

Third Embodiment

Now, Third Embodiment will be described with reference to FIGS. 9 and 10. It is noted that the following will describe arrangements different from those in First Embodiment and thus detailed description of the identical arrangements will be suitably omitted.

Figure 9:
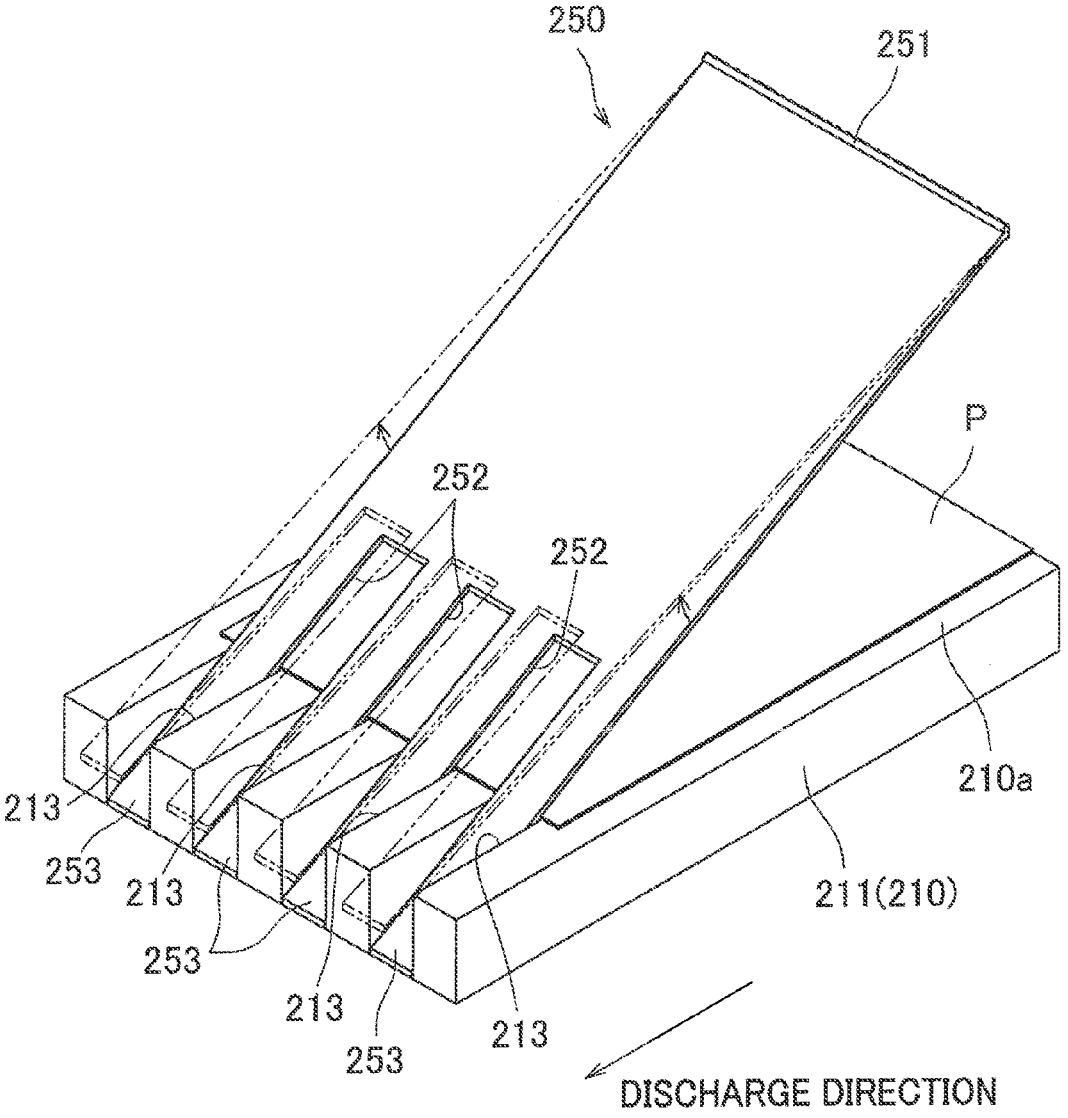
FIG. 9 is an oblique perspective of a discharge tray and a leading end press down unit of an inkjet printer of Third Embodiment.

In the present embodiment, as shown in FIG. 9, a leading end press down unit 250 is formed as a plate-shaped member, and an end portion on the side opposite to the supporting shaft 251 is irregularly shaped as concave portions 252 and protrusions 253 are alternately formed along the width direction of a sheet P supported by a supporting surface 210*a* of a discharge tray 210. Furthermore, at the downstream end portion in the discharge direction of the supporting surface 210*a* of the discharge tray 210, four grooves 213 are formed to extend in the discharge direction. Each groove 213 is disposed to positionally correspond to the protrusion 253 of the leading end press down unit 250, and a part (leading end portion) of the protrusion 253 enters the groove 213.

Figure 10:
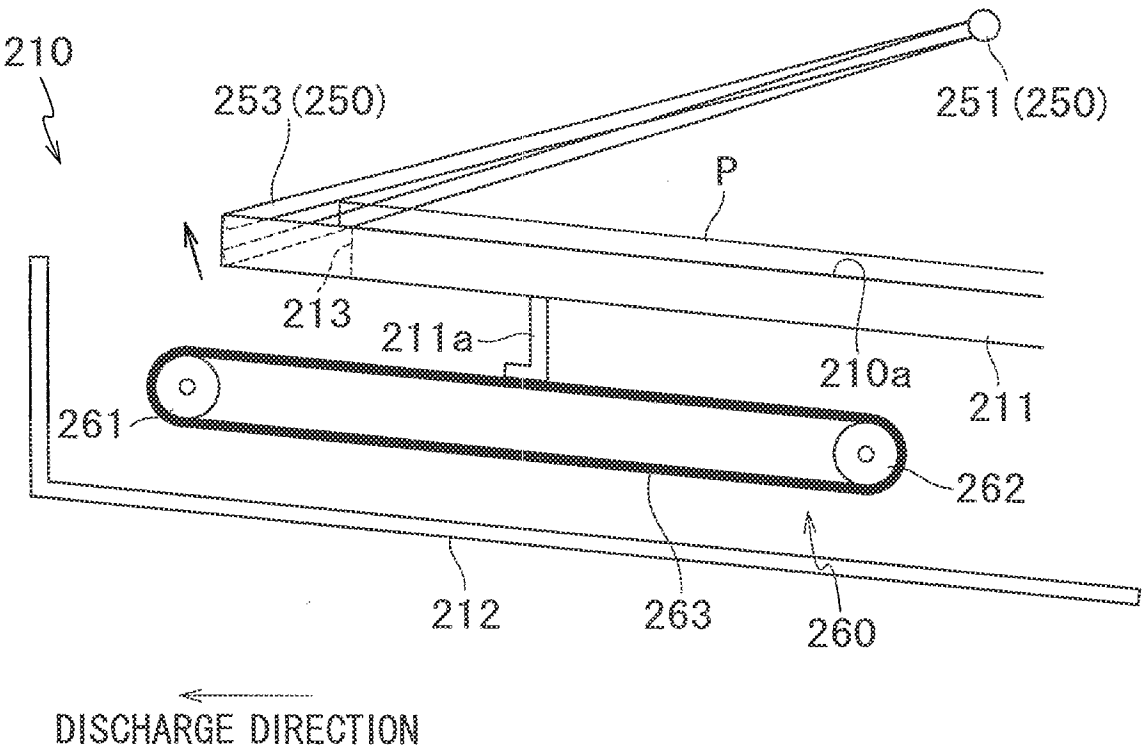
FIG. 10 shows the operations of the leading end press down unit shown in FIG. 9.

As shown in FIG. 10, the upper edge of the downstream end in the discharge direction of the sheet P discharged onto the discharge tray 210 contacts with the parts (proximal end portions) of the protrusions 253 of the leading end press down unit 250, which parts are outside the grooves 213. As the leading end press down unit 250 contacts with the sheet P discharged onto the discharge tray 210, the protrusions 253 in the grooves 213 move upward inside the groove 213.

Furthermore, as shown in FIG. 10, in the discharge tray 210 of the present embodiment, a supporter 211 having an upper surface functioning as a supporting surface 210*a* supporting the sheet P is provided in a concave tray main body 212, and a moving mechanism 260 which is configured to move the supporter 211 in the discharge direction and the direction opposite to the discharge direction is provided.

The moving mechanism 260 has a driven roller 261, a drive roller 262 driven by an unillustrated motor, and a drive belt 263. The driven roller 261 and the drive roller 262 are separated from each other in the discharge direction and are rotatable about, the respective rotation shafts which extend in the direction orthogonal to the discharge direction. The drive belt 263 is an endless belt wrapping between the driven roller 261 and the drive roller 262. On the lower surface of the supporter 211 is formed the protrusion 211*a* protruding downward, and the lower end portion of this protrusion 211*a* is fixed to the drive belt 263. Therefore, as the drive roller 262 is rotated clockwise or anticlockwise by the motor, the drive belt 263 moves and the supporter 211 is moved in the discharge direction or the direction opposite to the discharge direction.

As described above, according to the present embodiment, the protrusions 253 of the leading end press down unit 250 are in the respective grooves 213 formed on the supporting surface 210*a* of the discharge tray 210. This allows the leading end press down unit 250 to certainly apply its own weight to the upper edge of the downstream end in the discharge direction of the sheet P.

In addition to the above, the moving mechanism 260 is provided to move the supporter 211 having the grooves 213 in the discharge direction or the direction opposite to the discharge direction. This allows the leading end press down unit 250 to certainly press down a plurality of sheets P which are different from one another in length in the discharge direction.

In First to Third Embodiments above, the leading end press down unit 50 (150, 250) contacts only with the upper edge of the downstream end in the discharge direction of the sheet P supported by the supporting surface 10*a* (110*a*, 210*a*) of the discharge tray 10 (110, 210), so that the weight of the unit is applied to the upper edge in the downstream end. Alternatively, the leading end press down unit 50 contacts not only with the upper edge of the downstream end in the discharge direction of the sheet P supported by the supporting surface 140 of the discharge tray 10 but also with other parts of the sheet P, and applies its own weight to these contacted parts. In other words, as long as the leading end press down unit 50 can press down the upper edge of the downstream end in the discharge direction of the sheet P supported by the supporting surface 10*a* of the discharge tray 10, a part of the sheet P which part is adjacent to the upper edge of the downstream end in the discharge direction of the sheet P supported by the supporting surface 10*a* of the discharge tray 10 may be additionally pressed down.

While in First to Third Embodiments the leading end press down unit 50 (150, 250) is arranged to be movable toward and away from the supporting surface 10*a* (110*a*, 210*a*), the supporting surface 10*a* may be, instead of the leading end press down unit, arranged to be movable toward and away from the leading end press down unit 50.

In First to Third Embodiments, the leading end press down unit 50 (150, 250) extends in the direction intersecting with the width direction of the sheet P supported by the supporting surface 10*a* (110*a*, 210*a*) and the distance H between the leading end press down unit 50 and the supporting surface 10*a* increases toward the upstream in the discharge direction. Alternatively, for example, the leading end press down unit 50 may not have a part which extends in the direction intersecting with the width direction of the sheet P.

In addition to the above, in First to Third Embodiments, the leading end press down unit 50 (150, 250) is rotatable so that the downstream end in the discharge direction moves toward or away from the supporting surface 10*a* (110*a*, 210*a*). Alternatively, for example, the leading end press down unit 50 may be arranged to be vertically movable.

In addition to the above, in Second Embodiment above the pair of arms 152 of the leading end press down unit 150 is V-shaped when viewed from above. Alternatively, for example, the pair of arms 152 may be Y-shaped, as long as the arms are more distant from each other in the direction orthogonal to the discharge direction, toward the downstream in the discharge direction. Furthermore, the arms 152 may be curved in the direction orthogonal to the discharge direction.

In addition to the above, Second Embodiment above has described that, provided that the width of standard-sized sheets is a, the length of the sheets is b, and the angle formed by each arm 152 and a linear line extending along the discharge direction is $\theta_3$, the following equation (2) holds.

$$\tan \theta_3 = 0.5a/b \quad (2)$$

The value of $\theta_3$, however, is not limited to the above. In consideration of the press-down of a standard-sized sheet at two points, the relationship represented by the following equation (3) is preferable.

$$\tan \theta_3 \leq 0.5a/b \quad (3)$$

In addition to the above, while in Second Embodiment above the moving mechanism 160 is provided to move the supporter 111 having the upper surface functioning as the supporting surface 110*a* supporting the sheet P in the discharge direction and the direction opposite to the discharge direction, the moving mechanism 160 may not be provided.

In Third Embodiment above, the leading end portion of the leading end press down unit 250 is irregularly shaped to have the concave portions 252 and the protrusions 253 which are alternately formed along the width direction of the sheet P, and the grooves 213 formed on the supporting surface 210*a* positionally correspond to the protrusions 253 of the leading end press down unit 250. In this regard, a different structure may be employed as long as at least a part of the leading end portion of the leading end press down unit 250 enters a groove 213 formed on the supporting surface 210*a*.

In addition to the above, in First to Third Embodiments, the leading end press down unit 50 is moved away from the supporting surface 10*a* by the kinetic energy of the sheet P discharged onto the discharge tray 10. Alternatively, for example, the leading end press down unit 50 may be moved by a force generated by a motor or the like.

In Second Embodiment and Third Embodiment above, the supporter 111 (211) is moved in the discharge direction and the direction opposite to the discharge direction by the moving mechanism 160 (260). In Second Embodiment, however, the moving mechanism 160 may be differently arranged as long as at least the downstream end portion in the discharge direction of the supporting surface 110*a* is moved in the discharge direction and the direction opposite to the discharge direction. In Third Embodiment, the moving mechanism 260 may be differently arranged as long as at least a part of the supporting surface 210*a*, in which part the grooves 213 are formed, is moved in the discharge direction and the direction opposite to the discharge direction.

In addition to the above, while in the embodiments above the present invention is employed in the inkjet printer 101 which forms images by discharging ink, image forming apparatuses in which the present invention is employable are not limited to this printer. For example, the present invention may be employed in an electrophotographic printer.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An image forming apparatus comprising:

a discharge tray having a supporting surface supporting a recording medium;

a discharge mechanism which has a discharging slot through which the recording medium on which an image is formed is discharged along a conveying path, and is provided to discharge the recording medium from the discharging slot in a discharge direction which is a direction toward a space vertically above the supporting surface of the discharge tray; and a press down unit which is configured to relatively move toward and away from the supporting surface with respect to the discharge tray, the press down unit being relatively moved away from the supporting surface as the press down unit contacts with a downstream end in the discharge direction of the recording medium discharged onto the discharge tray by the discharge mechanism, and the press down unit applying a weight to the downstream end of the recording medium when the recording medium is supported by the supporting surface of the discharge tray;

wherein the press down unit is configured to be rotatable so that a downstream end in the discharge direction of the press down unit moves toward and away from the supporting surface;

wherein the press down unit includes a pair of arms which are directly connected to each other at a central area of the conveying path in an orthogonal direction orthogonal to the discharge direction, and which diverge from each other on opposite sides of the central area of the conveying path toward the downstream in the discharge direction; and wherein, as the recording medium discharged from the discharging slot by the discharge mechanism floats toward the downstream of the discharge direction of the recording medium, a contact position between each of the arms and the recording medium moves outward from a central part in the orthogonal direction of the recording medium.

2. The image forming apparatus according to claim 1;

wherein the press down unit extends in a direction intersecting with the width direction of the recording medium supported by the supporting surface of the discharge tray, and the distance between the press down unit and the supporting surface increases toward upstream in the discharge direction.

3. The image forming apparatus according to claim 1;

wherein the arms linearly extends from a fulcrum and are more distant from each other in the direction orthogonal to the discharge direction, toward the downstream in the discharge direction.

4. The image forming apparatus according to claim 3;

wherein, provided that the width of a standard-sized sheet which is the recording medium is a, the length of the standard-sized sheet is b, and an angle formed by each of the arms and a linear line extending along the discharge direction is $\theta$, $\tan \theta \leq 0.5a/b$ holds.

5. The image forming apparatus according to claim 1, further comprising:

a moving mechanism which is configured to move a downstream end portion in the discharge direction of the supporting surface of the discharge tray, in the discharge direction and the direction opposite to the discharge direction so as to vary a position of the downstream end portion of the supporting surface in a horizontal direction.

6. The image forming apparatus according to claim 5;

wherein a vertical position of a downstream end in the discharge direction of the press down unit is variable with a movement of a downstream end in the discharge direction of the supporting surface in the discharge direction or the direction opposite to the discharge direction, by the moving mechanism.

7. The image forming apparatus according to claim 1, further comprising:

a controller configured to control the discharge mechanism;

wherein the controller is configured to control the discharge mechanism so that the recording medium is discharged onto the discharge tray at a speed with which the kinetic energy of the recording medium discharged onto the discharge tray is not smaller than energy required to move the press down unit away from the supporting surface by a height which is equivalent to one recording medium.

8. The image forming apparatus according to claim 1;

wherein, in a top view, each of the arms is rotatable about a fulcrum which is on a movement locus of a central part in the orthogonal direction of the recording medium which is discharged from the discharging slot by the discharge mechanism, and each of the arms extends linearly from the fulcrum.

9. An image forming apparatus comprising:

a discharge tray having a supporting surface supporting a recording medium;

a discharge mechanism which has a discharging slot through which the recording medium on which an image is formed is discharged and is provided to discharge the recording medium from the discharging slot in a discharge direction which is a direction toward a space vertically above the supporting surface of the discharge tray; and a press down unit which is configured to relatively move toward and away from the supporting surface with respect to the discharge tray, the press down unit being relatively moved away from the supporting surface as the press down unit contacts with a downstream end in the discharge direction of the recording medium discharged onto the discharge tray by the discharge mechanism, and applying the own weight to the downstream end of the recording medium when the recording medium is supported by the supporting surface of the discharge tray;

wherein the press down unit is configured to be rotatable so that a downstream end in the discharge direction of the press down unit moves toward and away from the supporting surface;

wherein a leading end portion of the press down unit is irregularly shaped to have a concave portion and a protrusion which are alternately formed along the width direction of the recording medium supported by the supporting surface of the discharge tray;

wherein a groove is formed to positionally correspond to the protrusion of the press down unit, on the supporting surface of the discharge tray, and wherein the protrusion of the press down unit enters the groove.

10. The image forming apparatus according to claim 9;

wherein the groove is not formed to positionally correspond to the concave portion on the supporting surface.

11. The image forming apparatus according to claim 9, further comprising:

a moving mechanism which is configured to move a part of the supporting surface of the discharge tray in which part the groove is formed, in the discharge direction and the direction opposite to the discharge direction.

12. The image forming apparatus according to claim 11;

wherein a vertical position of a downstream end in the discharge direction of the press down unit is variable with a movement of a portion of the supporting surface having the groove, in the discharge direction or the direction opposite to the discharge direction, by the moving mechanism.

* * * * *